United States Patent [19]

Fogarty

[11] Patent Number: 4,884,818

[45] Date of Patent: Dec. 5, 1989

[54] BOARD GAME APPARATUS

[76] Inventor: William M. Fogarty, 7601 N. Federal Hwy. #265, Boca Raton, Fla. 33487

[21] Appl. No.: 304,129

[22] Filed: Jan. 31, 1989

[51] Int. Cl.[4] ..... A63F 3/06

[52] U.S. Cl. ..... 273/256; 273/269

[58] Field of Search ..... 273/256, 274, 249, 269

[56] References Cited

U.S. PATENT DOCUMENTS

| | | | |
|---|---|---|---|
| 3,889,954 | 6/1975 | Malisow | 273/256 |
| 4,522,407 | 6/1985 | Hatherley | 273/256 |
| 4,655,461 | 4/1987 | Capri et al. | 273/249 |

*Primary Examiner*—Edward M. Coven
*Assistant Examiner*—Benjamin Layno
*Attorney, Agent, or Firm*—Oltman & Flynn

[57] ABSTRACT

A board game apparatus for playing the lottery and having other competitive aspects. Each player has a game piece which the players in turn move along the outside and inside tracks of the game board, by rolling a pair of dice. The outside and inside tracks have various playing positions which involve competitive interaction between players, winning and losing play money, and obtaining and losing lottery tickets. Included in the play positions are several "play lottery" positions entitling a player landing thereon to play the lottery using the lottery tickets currently in his or her possession. The player marks six selected numbers on each ticket, then a random number generator is used to randomly select the winning lottery numbers. The player wins money according to the number of matching numbers.

19 Claims, 2 Drawing Sheets

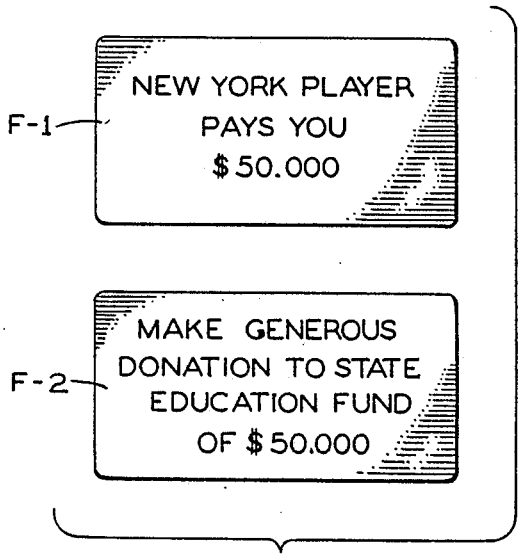
FIG. 3
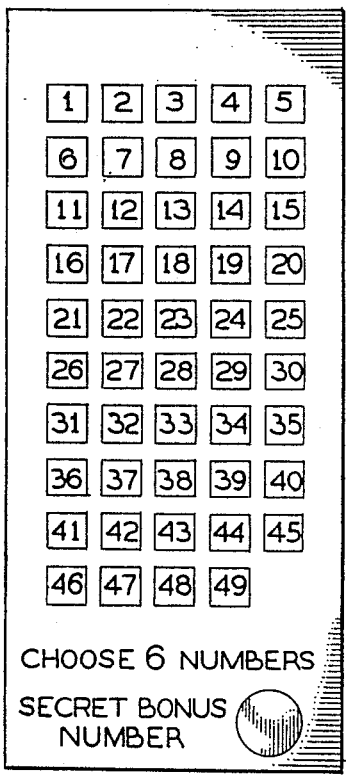
FIG. 4
FIG. 5
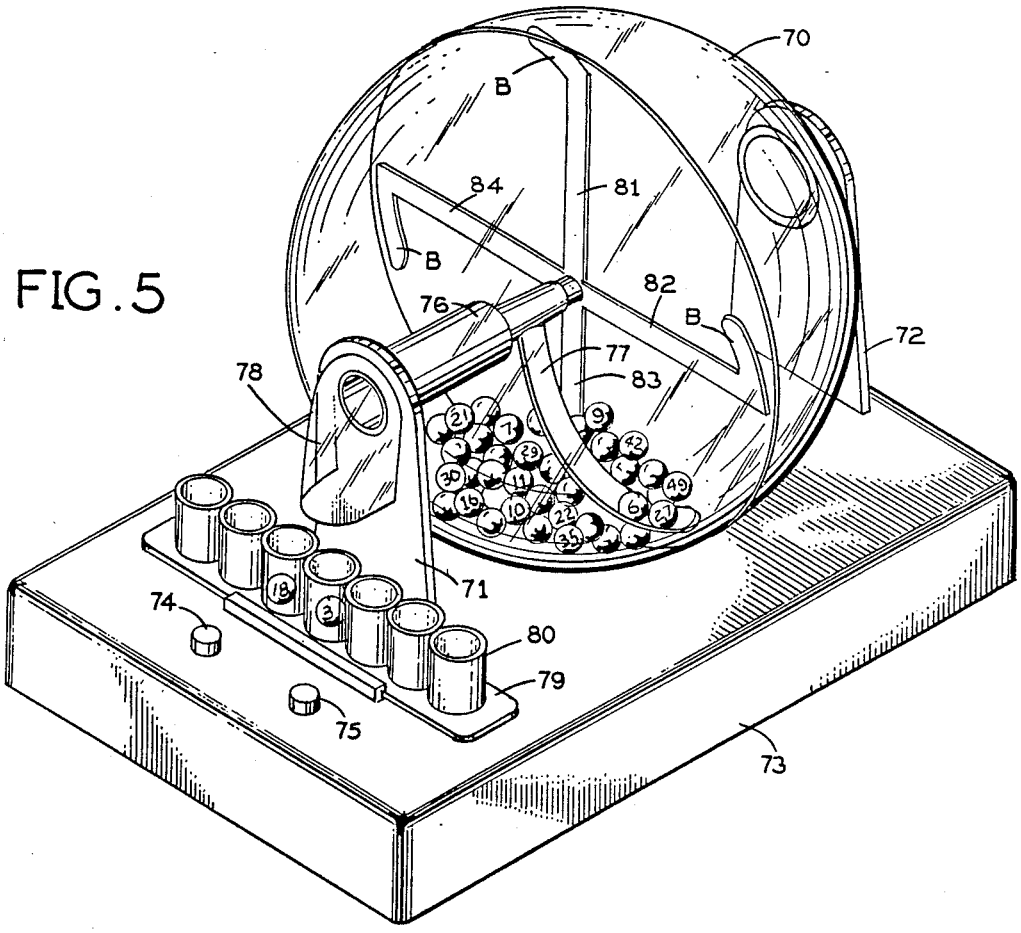

BOARD GAME APPARATUS

SUMMARY OF THE INVENTION

This invention relates to a board game apparatus which has several playing positions on the game board entitling a player to play lottery in much the same fashion as the lotteries now officially sponsored by a majority of the states of the United States, other playing positions which involve interaction with another player, and other playing positions which involve a benefit or a penalty to the player whose game piece lands thereon.

A principal object of this invention is to provide a novel board game apparatus which provides multiple permutations and combinations of luck and skill in playing the game to a conclusion in which one player of several wins the game.

In accordance with a presently preferred embodiment of the invention, the board game apparatus has a game board with an outside track having corner positions at which the players start the game and an inside track with a single corner position at which each player must start after becoming entitled to do so by landing on the player's own starting position on the outside track. Playing on the inside track offers higher rewards, in general, than playing on the outside track. The inside track has several positions which require a player landing thereon to leave the inside track and start again on the outside track. The players move their game pieces in accordance with dice which they roll in turn. Both the outside track and the inside track have several "play lottery" positions entitling a player landing there to play the lottery against a multiple random number generator. The outside and inside tracks on the game board have several playing positions which involve designated interactions between a player landing on such a position and another player. The outside and inside tracks also have non-interactive playing positions which involve various rewards and penalties to a player landing thereon. The game apparatus also includes a set of "fortune" cards which come into play when a player lands on one of several designated playing positions on the outside track. These fortune cards have various rewards and penalties to the players.

Further objects and advantages of this invention will be apparent from the following detailed description of a presently preferred embodiment which is illustrated schematically in the accompanying drawings.

DESCRIPTION OF THE DRAWINGS

FIG. 3 is a plan view of two of the "fortune" cards which are part of the board game apparatus;

FIG. 4 is a plan view of one of the lottery tickets; and

FIG. 5 is a perspective view of a multiple random number generator of known design which may be used to play lottery in the present board game apparatus.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
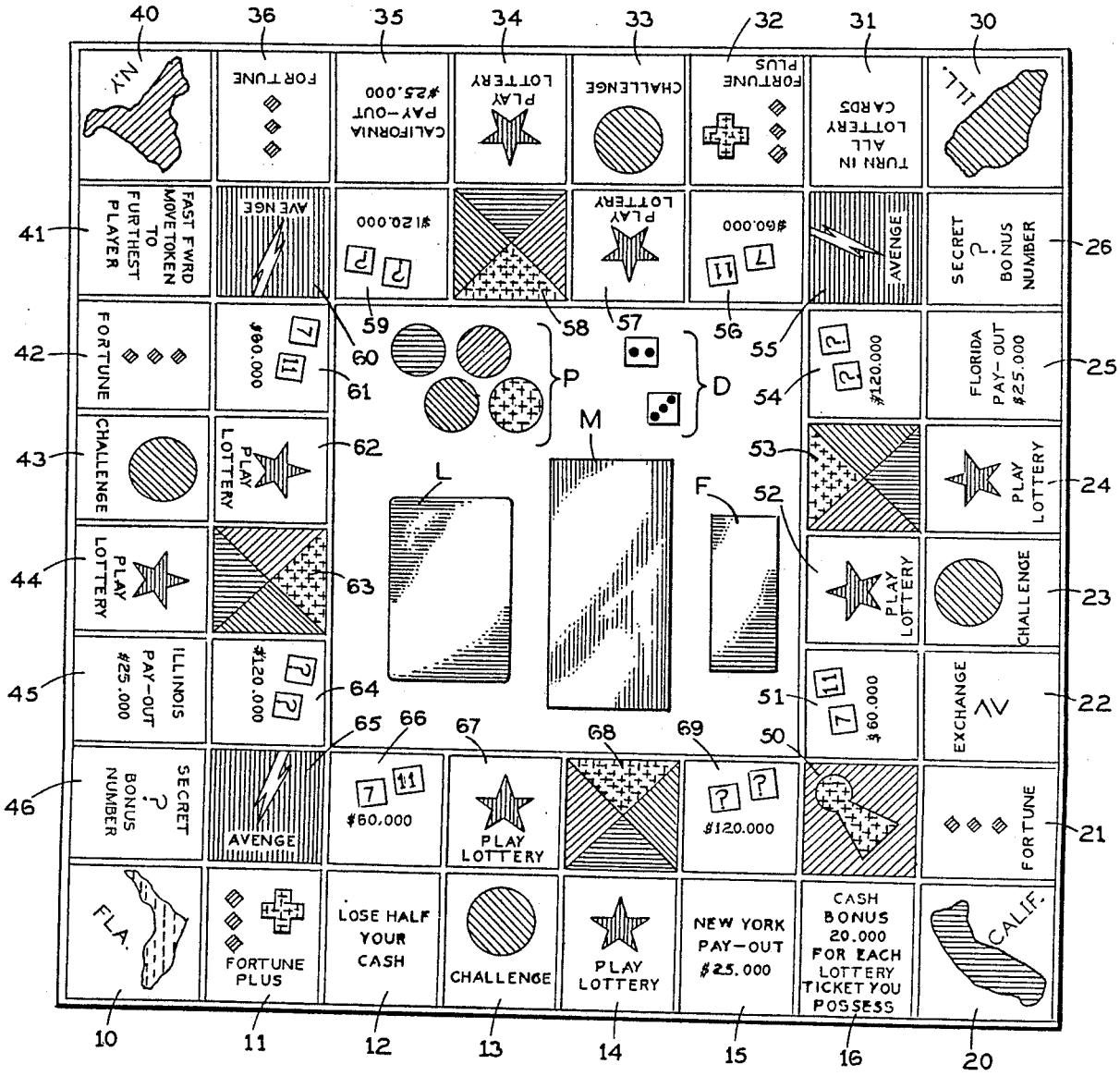
FIG. 1 is a plan view of the present board game apparatus except the multiple random number generator used to play lottery during a game.

The present invention, as illustrated in FIG. 1, comprises:

- a flat rectangular game board B with an outside track of successive playing positions in the form of a rectangular endless loop along its periphery, and a similar inside track of successive playing positions just inside the outside track;
- four differently colored playing pieces P, one for each of as many as four players;
- a pair of dice D which constitute a chance means played by the players in turn;
- a stack of play money M;
- a stack of "fortune" cards F;
- a stack of lottery tickets L;

and a random multiple number generator of known design (FIG. 5).

Figure 2:
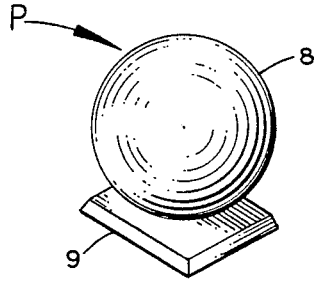
FIG. 2 is a perspective view of one of the game pieces in the present board game apparatus.

As shown in FIG. 2, each game piece P preferably has a distinctly colored ball 8 (which simulates a golf ball) on a flat base 9.

FIG. 3 shows two representative fortune cards in the stack F. Card F-1 brings a gain of $50,000 to the player who holds it. Card F-2 brings a loss to the player who holds it. The other fortune cards in the stack have a variety of beneficial and adverse consequences, as stated in detail hereinafter.

FIG. 4 shows one of the lottery tickets L, all of which are identical. Each lottery ticket has numbered squares 1-49, which the player can mark and a blank circle in which the player can mark a secret bonus number, as explained hereinafter.

FIG. 5 shows a multiple random number generator of known design which has a transparent hollow sphere 70 containing balls numbered 1-49. The sphere is rotatably supported by standards 71 and 72 extending up from a hollow base 73. The sphere is engaged frictionally from below by a wheel projecting up through the base and driven rotatably by an electric motor in the base. A first push-button 74 operates a first switch for causing the motor to drive sphere 70 in one direction. A second push-button 75 operates a second switch for causing the motor to drive sphere 70 in the opposite direction.

A hollow central arm 76 inside the sphere 70 extends horizontally from standard 71. Near its inner end inside the sphere, arm 76 has an opening for receiving one ball at a time from a curved scoop 77 attached to this arm. At its outer end, arm 76 passes the balls one at a time to a chute 78 on the outside of standard 71.

A ball catcher 79 is slidably mounted on top of base 73 below chute 78. This ball catcher has a plurality of cylindrical pockets 80 for receiving balls that drop down through chute 78.

A ball-mixing paddle inside the sphere 70 presents four radial arms 81,82,83 and 84 extending out from the central arm 76 and carrying angularly offset blades B on their outer ends close to the inside surface of sphere 70. The ball-mixing paddle is attached to the inner end of the central arm 76 to turn in unison with that arm as the motor-driven sphere 70 is rotated.

When push-button 74 is depressed, the hollow sphere 70 rotates clockwise FIG. 5, as do the central arm 76, scoop 77 and the ball-mixing paddle 81–84. The weight of the numbered balls causes them to remain in the bottom of the hollow-sphere 70. The paddle mixes the numbered balls but the scoop 77 does not scoop them up.

After the balls have been mixed sufficiently, push-button 74 is released and the other push-button 75 is depressed, causing sphere 70, its central arm 76, scoop 77 and the mixing paddle 81–84 to rotate counter-clockwise in FIG. 5. The scoop 77 scoops up numbered balls and drops them into the hollow central shaft 76, which passes them out to the chute 78. The player operating this device moves the ball catcher 79 so that each pocket 80 receives a single numbered ball.

It is to be understood that the random number generator just described is given only as one example and that the present invention may have a random number generator different from this one, such as an electronic random number generator with a visual display of the generated number.

The game board at its four corners (beginning at the lower left corner in FIG. 1 and proceeding counter-clockwise) has starting positions 10,20,30 and 40, one for each player, and each designating a corresponding state which has an officiel lottery - Florida, California, New York and Illinois. The four game pieces P are moved counter-clockwise along the outside track.

Each of the four players starts with $60,000 of play money from the bank. The game is over when any player has $1,000,000.

At the start of the game, one player is chosen to be the lottery director who manages all the money and operates the multiple random number generator (FIG. 5) when any player is playing lottery. At the beginning of the game, the lottery director puts $50,000 in the State Education Fund and during the game the director replenishes this fund to bring it up to $50,000 whenever it drops below that amount.

The outside track of the game board (FIG. 1) has four lottery-play positions, 14,24,34 and 44, one on each side of this rectangular endless loop path.

The inside track has a single starting position 50 (at the lower right corner in FIG. 1) where any player's game piece must start when taken from the outside track to the inside track, as explained hereinafter. The game pieces are moved counter-clockwise along the inside track after entering it at playing position 50.

The inside track has four lottery-play positions 52,57,62 and 67, one on each side of this rectangular endless loop path.

Any time a player's game piece lands on any lottery-play position on the outside or inside track, if that player owns at least three lottery tickets L, that player has the option to play the lottery against the multiple random number generator (FIG. 5), as explained hereinafter. To play the lottery involves the opportunity to win big or lose big toward the goal of ending the game by accumulating $1,000,000 of play money.

The outside track of the game board has other playing positions which are especially significant in that they initiate an interaction between the player whose game piece lands on that playing position and another player chosen by him or her. These are:

four "challenge" positions 13,23,33 and 43;

a single "exchange" position 22;

a single "fast-forward" position 41;

and two "fortune plus" positions 11 and 32.

The inside track of the game board has three interactive playing positions, the "avenge" positions, at the corners 55,60 and 65.

The remaining playing positions on both the outside track and the inside track have consequences, either beneficial or adverse, for the player whose game piece lands on them but no direct interaction with another player.

The four corners 10,20,30 and 40 are the respective starting positions for the Florida, California, Illinois and New York players, who have successive turns rolling the two dice D. At the start of the game, and before each subsequent turn to roll the dice, a player may purchase one or more lottery tickets L for $20,000 each in play money but in no event is a player allowed to buy more than six lottery tickets per turn. Whenever any player passes his or her own starting corner (e.g., when the Florida player passes the Florida corner 10), that player receives $20,000 of play money M from the bank. Whenever any player lands on his or her own starting corner, that player receives $60,000 of play money M from the bank and moves his or her game piece from the outside track to the starting position 50 at the lower right corner of the inside track and then awaits his or her turn to play on the inside track. Whenever any player lands on any outside corner 10,20,30 or 40 that is not his or her own, he or she pays a $5,000 penalty into the State Education Fund. If such a player lacks the full $5,000 to pay this penalty, he or she must turn in a lottery ticket (redeemable for $10,000 of play money) and receive the balance in play money.

The outside track has four pay-out positions, 15,25,35 and 45, one for each state player. For example, if the Florida player lands on the Florida pay-out position 25, he or she receives $25,000 of play money M from the bank, but if the Florida player lands on the New York pay-out position 15 or on the California pay-out position 35 or the Illinois pay-out position 45 he or she receives nothing.

The outsde track has a single "lose half your cash" playing position 12. Any player who lands on this position must pay half his or her play money into the State Education Fund.

The outside track has a single "cash bonus" playing position 16. Any player who lands on this position receives $20,000 for each lottery ticket he or she then has.

The outside track has two "secret bonus number" playing positions 26 and 46. Any player who lands on one of these can write in the blank circle (FIG. 4) on one of his lottery tickets any number from 1 to 49 selected by that player. There is a limit of one bonus number per lottery ticket. If that player has no lottery ticket at that time, he or she cannot select such a bonus number.

The outside track has a single "fast-forward" playing position 41. A player who lands on this laying position can move his or her game piece to the playing position of any other game piece on the outside track farthest away (counter-clockwise). If in doing so the player passes his or her own starting corner 10,20,30 or 40, he or she receives $20,000 of play money M from the bank. If there is no other game piece on the outside track when a player lands on the "fast-forward" playing position, that player's game piece remains there until his or her next turn to play.

The outside track has a single "exchange" playing position 22. A player who lands here can change places with any other player's game piece on either the outside track or the inside track. If this puts the player on his own starting corner 10,20,30 or 40, he or she receives $60,000 of play money from the bank and puts the game piece on the starting position 50 of the inside track. If this exchange causes the player to pass his own starting corner, there is no payment for this. The player whose playing position was exchanged now puts his or her game piece on playing position 22, where that player waits for his or her next turn to roll the dice.

The outside track has three "fortune" playing positions 21,36 and 42. A player landing on any of these positions must take a fortune card F from the stack and do whatever it says, as explained hereinafter under the heading FORTUNE CARDS.

The outside track has two "fortune plus" playing positions 11 and 32. A player who lands on either of these positions designates any other player of his or her choice to pick up the next fortune card and follow its directions.

The outside track has a single "turn in all lottery tickets" playing position 31. A player landing here must give up all his or her lottery tickets, which is a very severe setback. This player surrenders his or her tickets to the lottery director, who destroys them.

There are four "challenge" playing positions 13,23,33 and 43 on the outside track of the game board. The basic rule is that a player landing on any of these "challenge" positions must challenge any other player of his or her choice to a dice roll-off to a selected number of the lottery tickets held by both players. The challenging player and the challenged player roll the dice in turn and the first one to roll 7 or 11 wins the other's lottery tickets at risk in the challenge. However, if the challenging player has no lottery tickets then there can be is no challenge contest and the same is true if no other player has any lottery tickets. Also, the challenged player has the option, before the roll-off, of paying into the State Education Fund $10,000 for each lottery ticket chosen by the challenger in issuing the challenge which the challenged player does not want to risk.

A player whose game piece lands on any of the three "avenge" corner positions 55,60 and 65 of the inside track has these options:

(1) take half of any other player's cash; or
(2) take as many as six lottery tickets from any other player, the other player making the selection of which lottery tickets are taken from him or her; or
(3) require any other player whose game piece is on the inside track to move it to the corresponding starting position 10,20,30 or 40 on the outside track and await his or her next turn to roll the dice, without receiving any play money for being on that starting position.

The inside track, in addition to the starting position 50 at one corner, the "avenge" positions 55,60,65 at the remaining corners, and the four lottery-play positions 52,57,62 and 67, has four "7-11" playing positions 51,56,61 and 66. Whenever a player lands on one of these "7-11" playing positions, he or she rolls the dice once again and if they total seven or eleven that player receives $60,000 of play money from the bank. If not, the player waits for his or her next turn to play.

The inside track also has four "mystery dice" playing positions 54,59,64 and 69. A player landing on any of these playing positions announces two numbers from 2 to 12, inclusive, and rolls the dice again. If the total of the dice equals either announced number, that player receives $120,000 of play money M from the bank.

The inside track has four "exit" playing positions 53,58,63 and 68. A player landing on any of these must move his game piece to his or her starting position 10,20,30 or 40 on the outside track and await his or her turn to roll the dice, without receiving any play money for being on that starting position.

PLAY LOTTERY

Turning now to the play-lottery positions on the outside track, 14,24,34 and 44, and on the inside track, 52,57,62 and 67, when a player lands on any one of these positions the following rules apply:

(1) To play the lottery, the player must have at least three lottery tickets L.
(2) Each lottery ticket costs a player $20,000 of play money.
(3) A player may purchase lottery tickets only at the beginning of that player's turn to roll the dice.
(4) A player may redeem any or all of his or her lottery tickets for $10,000 each only at the beginning of that player's turn to roll the dice.
(5) A maximum of the six lottery tickets can be purchased at one time by a player.
(6) A player who lands on any play-lottery position must mark six selected numbers from 1-49 on each of one to six lottery tickets he or she holds. Those tickets only are in play.
(7) If the player chooses to play a lottery ticket previously marked with a bonus number in the blank circle (from having landed on playing position 26 or 46 on the outside track), the player may do so.
(8) No lottery ticket can be played more than once.
(9) The player turns his or her marked lottery tickets face up, so all the other players can see the numbers marked on them.
(10) The lottery director operates the random number generator (FIG. 5) to produce six numbers. For each lottery ticket there is a six-number-per-ticket payout, as follows:

| | | |
|---|---|---|
| one | matching number | $ 50,000 |
| two | matching numbers | $100,000 |
| three | matching numbers | $250,000 |
| four | matching numbers | $500,000 |
| five | matching numbers | $750,000 |
| six | matching numbers | $1,000,000 |

(11) If a lottery ticket played in the lottery has a bonus number marked on it that matches any of the numbers produced by the random number generator, the player holding that ticket receives all the money in the State Education Fund at that time. If more than one player has a bonus number that matches any number produced by the random number generator, the money in the State Education Fund is divided equally among them. No player may present to the lottery director more than one lottery ticket having a matching bonus number.
(12) All the lottery tickets put in play by that player, whether with winning numbers or without, are destroyed or otherwise eliminated from the remainder of the game.
(13) A player landing on a play-lottery position can opt not to play the lottery.

FORTUNE CARDS

The set of fortune cards F includes three "exemption" cards which a player holding can use once during the game to avoid any fine or penalty that would otherwise be applicable to that player except the following: (1) a challenge by another player landing on one of the "challenge" positions 13,23,33 or 43; and (2) a fine or penalty imposed by another fortune card.

The set of fortune cards also includes nine number cards, each with a single number from 1 to 9. When a player has landed on one of the "fortune" positions 21,36 or 42 on the outside track and has picked up a fortune card that is numbered, that player tells the others that he or she has just picked up a number card. Each other player makes one guess as to what that number is. A player who guesses correctly receives a free lottery ticket and a bonus number. However, if no player guesses correctly, the player who picked up the numbered fortune card receives a free lottery ticket and a bonus number.

The set of fortune cards also includes the following:

cards entitling a player to receive money from the game bank or from another player;

cards entitling a player to move his or her game piece to the starting corner 50 of the inside track of the game board;

cards entitling a player to take another player's lottery tickets or another player's exemption cards;

a card entitling a player to change places on the game board with any other player;

a card entitling a player to move his or her game piece to the pay-out position 15,25,35 or 45 for his or her state;

a card entitling a player to move his or her game piece to the pay-out position 15,25,35 or 45 closest to where the game piece is now;

cards requiring a player to pay money to the bank or the State Education Fund or another player;

a card requiring a player to give up a designated number of lottery tickets;

a card requiring a player to give up all the exemption cards he or she now holds;

cards involving a loss of the player's turn at rolling the dice;

a card involving the loss of all bonus numbers marked on lottery tickets held by that player; and a card entitling a player to take another player's lottery ticket which has a secret bonus number.

A final rule of the game is that every player stays in the game until some player ends it by winning $1,000,000. If a player runs out of play money and lottery tickets, that player remains in the game with the possibility of winning it. Any fine or penalty incurred by a player during the game does not apply to the extent that it exceeds the total of money and the redemption value of lottery tickets then held by the player.

I CLAIM:

1. A board game apparatus comprising:

a game board having track means thereon with a series of playing positions in succession, at least one of said playing positions being a lottery-play position;

a plurality of game pieces for movement by respective players along said track means;

chance means for use by the players in turn to determine how far a player's game piece is to be moved after each turn of said player with said chance means;

a plurality of lottery tickets each having means thereon for a player to select a number when a player's game piece lands on a lottery-play position;

and a random number generator for producing a plurality of winning lottery numbers against which said player whose game piece is at a lotter-play position on the game board compares the selected numbers on that player's selected lottery tickets.

2. A board game apparatus according to claim 1 wherein:

said game board has an endless-loop outer track and an endless-loop inner track thereon;

said outer track having at least one playing position thereon designated for moving a game piece from said outer track to said inner track when said game piece lands on said one playing position;

said inner track having at least one playing position thereon designated for moving a game piece landing thereon from said inner track to said outer track;

said outer track having a plurality of said lottery-play positions thereon;

and said inner track having a plurality of said lottery-play positions thereon.

3. A board game apparatus according to claim 2 wherein said outer track has an exchange position thereon which entitles any player whose game piece lands thereon to change places with any other player's game piece on either said outside track or said inside track.

4. A board game apparatus according to claim 2 wherein:

said chance means is a pair of dice;

and said playing positions on the outer track include a plurality of challenge positions each entitling a player whose game piece lands thereon to challenge any other player to a competitive rolling of said dice in turn for as many lottery tickets as are selected by the challenging player and held by both the challenging player and the challenged player.

5. A board game apparatus according to claim 2 wherein said playing positions on the inside track include a plurality of avenge positions entitling a player whose game piece lands thereon to require any other player to:

(a) pay play money to the player whose game piece is on an avenge position; or (b) pay a plurality of lottery tickets to the player whose game piece is on an avenge position; or (c) move said other player's game piece from the inside track to the outside track of the game board.

6. A board game apparatus according to claim 2 wherein:

said chance means is a pair of dice;

said playing positions on the outer track include a plurality of challenge positions each entitling a player whose game piece lands thereon to challenge any other player to a competitive rolling of said dice in turn for as many lottery tickets as are designated by the challenging player and held by both the challenging player and the challenged player;

and said playing positions on the inside track include a plurality of avenge positions entitling a player whose game piece lands thereon to require any other player to:

(a) pay play money to the player whose game piece is on an avenge position; or (b) pay a plurality of lottery tickets to the player whose game piece is on an avenge position; or (c) move said other player's game piece from the inside track to the outside track of the game board.

7. A board game apparatus according to claim 2 wherein:

said outer track has a plurality of corners, each of which is the starting position for a corresponding player;

and said inner track has a like plurality of corners, one of which is the starting position on the inside track for all players.

8. A board game apparatus according to claim 7 wherein the remaining corner positions on the inside track are avenge positions entitling a player whose game piece lands thereon to require any other player to:

(a) pay play money to the player whose game piece is on an avenge position; or (b) pay a plurality of lottery cards to the player whose game piece is on the avenge position; or (c) move said other player's game piece.

9. A board game apparatus according to claim 8 wherein said outside track has a plurality of playing positions entitling a player whose game piece lands thereon to enter a lottery number on one of said lottery tickets held by that player.

10. A board game apparatus according to claim 1 wherein said playing positions on the board include an exchange position entitling a player whose game piece lands thereon to change places with any other player's game piece on the board.

11. A board game apparatus according to claim 1 wherein said playing positions on the board include a plurality of challenge positions each entitling a player whose game piece lands thereon to challenge any other player to a competitive playing of said chance means for as many lottery tickets as are selected by the challenging player and held by both the challenging player and the challenged player.

12. A board game apparatus according to claim 11 wherein:

said chance means is a pair of dice;

and the winner of said competitive playing of said chance means is the first player to roll 4 or 5.

13. A board game apparatus according to claim 1 and further comprising a stack of fortune cards with directions thereon, and wherein said playing positions on the board include at least one position entitling a player whose game piece lands thereon to take the next fortune card in said stack and follow its directions.

14. A board game apparatus according to claim 1 and further comprising a stack of fortune cards with directions, and wherein said outer track has a plurality of playing positions each entitling a player whose game piece lands thereon to designate any other player to take the next fortune card in said stack and follow its directions.

15. A board game apparatus according to claim 1 wherein said playing positions on the board include a plurality of avenge positions entitling a player whose game piece lands thereon to impose a penalty on any other player.

16. A board game apparatus according to claim 15 wherein said penalty is selected from the following:

(a) payment of play money to the player whose game piece is on an avenge position;

(b) payment of a plurality of lottery tickets to the player whose game piece is on an avenge position; and (c) movement of the penalized player's game piece to a different position on the game board.

17. A board game apparatus according to claim 1 and further comprising a stack of fortune cards with directions thereon, and wherein said playing positions on the board include:

at least one position entitling a player whose game piece lands thereon to take the next fortune card and follow its directions;

at least one position entitling a player whose game piece lands thereon to designate any other player to take the next fortune card in said stack and follow its directions;

and a plurality of challenge positions each entitling a player whose game piece lands thereon to challenge any other player to a competitive playing of said chance means for as many lottery tickets as are designated by the challenging player and held by both the challenging player and the challenged player.

18. A board game apparatus according to claim 1 wherein said playing positions on the board include a fast-forward position entitling a player whose game piece lands thereon to move said game piece to the playing position of another player's game piece farthest away along said track means.

19. A board game apparatus according to claim 1 wherein said playing positions on the board include at least one position entitling a player whose game piece lands thereon to enter a lottery number on one of said lottery tickets held by that player.

* * * * *